US011807818B2

(12) United States Patent
Koseoglu

(10) Patent No.: US 11,807,818 B2
(45) **Date of Patent: *Nov. 7, 2023**

(54) INTEGRATED FCC AND AROMATIC RECOVERY COMPLEX TO BOOST BTX AND LIGHT OLEFIN PRODUCTION

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 16 days.

This patent is subject to a terminal disclaimer.

(21) Appl. No.: 17/143,296

(22) Filed: Jan. 7, 2021

(65) Prior Publication Data

US 2022/0213395 A1 Jul. 7, 2022

(51) Int. Cl.
*C10G 61/10* (2006.01)
*C10G 9/36* (2006.01)
(Continued)

(52) U.S. Cl.
CPC ..... *C10G 61/10* (2013.01); *C10G 9/36* (2013.01); *C10G 11/05* (2013.01); *C10G 11/187* (2013.01);
(Continued)

(58) Field of Classification Search
CPC ..... C10G 63/00; C10G 63/02; C10G 63/04; C10G 69/02; C10G 69/04; C10G 69/06;
(Continued)

(56) References Cited

U.S. PATENT DOCUMENTS 3,074,878 A 1/1963 Pappas
3,132,087 A 5/1964 Kelley et al.
(Continued)

FOREIGN PATENT DOCUMENTS

CN 107177374 B 1/2019
CN 109718760 A 5/2019
(Continued)

OTHER PUBLICATIONS

International Search Report and Written Opinion dated Sep. 28, 2021 pertaining to International application No. PCT/US2021/020784 filed Mar. 4, 2021, 12 pages.
(Continued)

*Primary Examiner* — Michelle Stein
(74) *Attorney, Agent, or Firm* — DINSMORE & SHOHL LLP

(57) ABSTRACT

In accordance with one or more embodiments of the present disclosure, a process for converting diesel to products comprising light olefins, benzene-toluene-xylenes (BTX), fluid catalytically cracked naphtha, pyrolysis gasoline, and pyrolysis fuel oil includes: introducing a diesel feedstream to a diesel hydrodesulfurization unit to produce a desulfurized diesel stream; introducing the desulfurized diesel stream to a fluid catalytic cracking (FCC) unit to produce the fluid catalytically cracked naphtha, a light gas stream, and a cycle oils stream; introducing the fluid catalytically cracked naphtha to an aromatic recovery complex to produce the BTX and an aromatic bottoms stream; and introducing a paraffinic fraction of the light gas stream to a steam cracking unit to produce a light olefins stream, the pyrolysis gasoline, and the pyrolysis fuel oil.

11 Claims, 2 Drawing Sheets

(51) Int. Cl.

| | |
|---|---|
| ***C10G 11/05*** | (2006.01) |
| ***C10G 11/18*** | (2006.01) |
| ***C10G 35/24*** | (2006.01) |
| ***C10G 45/02*** | (2006.01) |
| ***C10G 55/06*** | (2006.01) |

(52) U.S. Cl.

CPC ..... *C10G 35/24* (2013.01); *C10G 45/02* (2013.01); *C10G 55/06* (2013.01); *C10G 2300/1044* (2013.01); *C10G 2300/1055* (2013.01); *C10G 2300/202* (2013.01); *C10G 2300/4006* (2013.01); *C10G 2300/4018* (2013.01); *C10G 2300/4025* (2013.01); *C10G 2300/70* (2013.01); *C10G 2400/02* (2013.01); *C10G 2400/06* (2013.01); *C10G 2400/20* (2013.01); *C10G 2400/30* (2013.01)

(58) Field of Classification Search

CPC ..... C10G 69/08; C10G 61/10; C10G 45/02; C10G 35/00–24; C10G 11/18; C10G 11/05; C10G 11/187; C10G 9/36; C10G 55/06; C10G 2300/202; C10G 2300/1055; C10G 2300/4018; C10G 2300/1044; C10G 2300/70; C10G 2300/4025; C10G 2300/4006; C10G 2400/02; C10G 2400/06; C10G 2400/30; C10G 2400/20; C10G 2400/4025; C10G 63/06; C10G 63/08

See application file for complete search history.

(56) References Cited

U.S. PATENT DOCUMENTS

| | | | | |
|---|---|---|---|---|
| 3,159,568 | A | 12/1964 | Price et al. | |
| 3,210,264 | A | 10/1965 | Haney | |
| 3,240,694 | A | 3/1966 | Mason et al. | |
| 3,305,476 | A | 2/1967 | York et al. | |
| 3,420,768 | A | 1/1969 | Bray et al. | |
| 3,702,292 | A * | 11/1972 | Burich | C10G 69/10 422/139 |
| 3,758,403 | A | 9/1973 | Rosinski et al. | |
| 3,758,628 | A * | 9/1973 | Strickland | C10L 1/06 585/303 |
| 3,894,931 | A | 7/1975 | Nace et al. | |
| 3,894,933 | A * | 7/1975 | Owen | C10G 51/026 208/77 |
| 3,894,934 | A | 7/1975 | Owen et al. | |
| 4,176,053 | A | 11/1979 | Holcombe | |
| 4,394,301 | A | 7/1983 | Gardner | |
| 4,419,221 | A | 12/1983 | Castagnos, Jr. et al. | |
| 4,476,345 | A | 10/1984 | Gray, Jr. et al. | |
| 4,695,368 | A | 9/1987 | Ward | |
| 4,713,167 | A | 12/1987 | Reno et al. | |
| 4,789,457 | A | 12/1988 | Fischer et al. | |
| 4,826,587 | A | 5/1989 | Ward et al. | |
| 4,828,676 | A | 5/1989 | Sawyer et al. | |
| 4,913,799 | A | 4/1990 | Gortsema et al. | |
| 4,950,384 | A | 8/1990 | Groeneveld et al. | |
| 4,980,053 | A | 12/1990 | Li et al. | |
| 5,026,472 | A | 6/1991 | Hoehn et al. | |
| 5,147,526 | A | 9/1992 | Kukes et al. | |
| 5,326,465 | A | 7/1994 | Yongqing et al. | |
| 5,364,514 | A | 11/1994 | Sanborn et al. | |
| 5,462,652 | A | 10/1995 | Wegerer | |
| 5,552,033 | A * | 9/1996 | Shih | C10G 59/02 208/65 |
| 5,863,315 | A | 1/1999 | Jullian et al. | |
| 5,885,440 | A | 3/1999 | Hoehn et al. | |
| 5,904,835 | A | 5/1999 | Thakkar | |
| 6,113,775 | A | 9/2000 | Christolini et al. | |
| 6,217,746 | B1 | 4/2001 | Thakkar et al. | |
| 6,312,586 | B1 | 11/2001 | Kalnes et al. | |
| 6,478,952 | B1 * | 11/2002 | Lin | B01J 23/6567 208/134 |
| 6,656,346 | B2 | 12/2003 | Ino et al. | |
| 7,271,303 | B1 | 9/2007 | Sechrist et al. | |
| 9,464,241 | B2 | 10/2016 | Koseoglu et al. | |
| 10,053,401 | B1 | 8/2018 | Beadle et al. | |
| 10,093,873 | B2 | 10/2018 | Koseoglu et al. | |
| 11,162,039 | B1 * | 11/2021 | Koseoglu | C10G 45/44 |
| 11,370,980 | B2 * | 6/2022 | Koseoglu | C10G 35/095 |
| 2003/0006168 | A1 * | 1/2003 | Ino | C10G 11/18 208/120.01 |
| 2006/0021912 | A1 | 2/2006 | Chen et al. | |
| 2007/0272593 | A1 | 11/2007 | Stockwell et al. | |
| 2009/0159494 | A1 | 6/2009 | Gautam et al. | |
| 2009/0283442 | A1 | 11/2009 | McCall et al. | |
| 2009/0288985 | A1 * | 11/2009 | Long | C07C 5/11 208/57 |
| 2012/0016167 | A1 | 1/2012 | Hanks | |
| 2013/0259764 | A1 | 10/2013 | Zimmerman et al. | |
| 2013/0291432 | A1 | 11/2013 | Al-Therwi et al. | |
| 2014/0171704 | A1 | 6/2014 | Erisken et al. | |
| 2014/0221715 | A1 * | 8/2014 | Bridges | C10G 63/04 422/187 |
| 2014/0275673 | A1 | 9/2014 | Long et al. | |
| 2014/0357913 | A1 * | 12/2014 | Funk | C10G 69/04 585/319 |
| 2015/0045597 | A1 * | 2/2015 | Funk | C10G 61/10 585/300 |
| 2015/0045598 | A1 * | 2/2015 | Funk | C10G 69/10 585/300 |
| 2015/0141725 | A1 | 5/2015 | Lippmann et al. | |
| 2015/0166435 | A1 * | 6/2015 | Serban | C10G 63/08 422/187 |
| 2015/0284644 | A1 | 10/2015 | Fanget et al. | |
| 2015/0284646 | A1 * | 10/2015 | Fanget | C10G 69/08 585/321 |
| 2016/0362617 | A1 * | 12/2016 | Oprins | C10G 9/36 |
| 2017/0327754 | A1 * | 11/2017 | Ding | C10G 9/36 |
| 2018/0223197 | A1 | 8/2018 | Al-Ghamdi et al. | |
| 2018/0340125 | A1 * | 11/2018 | Funk | C10G 61/04 |
| 2019/0040328 | A1 | 2/2019 | Koseoglu | |
| 2019/0203130 | A1 | 7/2019 | Mukherjee | |
| 2019/0359541 | A1 * | 11/2019 | Bafna | C10G 69/14 |
| 2020/0102509 | A1 | 4/2020 | Bhuwania et al. | |
| 2021/0253959 | A1 * | 8/2021 | Koseoglu | C10G 65/043 |
| 2021/0363439 | A1 * | 11/2021 | Xu | C10G 35/04 |
| 2022/0220397 | A1 * | 7/2022 | Koseoglu | C10G 11/18 |
| 2022/0228075 | A1 * | 7/2022 | Koseoglu | C10G 69/10 |

FOREIGN PATENT DOCUMENTS

| | | | |
|---|---|---|---|
| CN | 110591759 | A | 12/2019 |
| EP | 0512635 | B2 | 11/1992 |
| EP | 3536765 | A1 | 9/2019 |
| WO | 2020205210 | A1 | 10/2020 |

OTHER PUBLICATIONS

U.S. Office Action dated Sep. 30, 2021 pertaining to U.S. Appl. No. 17/149,789, filed Jan. 15, 2021, 23 pages.

Office Action dated Jun. 24, 2021 pertaining to U.S. Appl. No. 17/143,286, filed Jan. 7, 2021, 16 pages.

Notification of Transmittal of the International Search Report and the Written Opinion of the International Searching Authority, or the Declaration dated Apr. 5, 2022 pertaining to International application No. PCT/US2022/011025 filed Jan. 3, 2022, 12 pages.

U.S. Office Action dated Apr. 22, 2022 pertaining to U.S. Appl. No. 17/149,789, filed Jan. 15, 2021, 23 pages.

International Search Report and Written Opinion dated Feb. 24, 2022 pertaining to International application No. PCT/US2021/058505 filed Nov. 9, 2021, 14 pages.

U.S. Office Action dated Dec. 2, 2021 pertaining to U.S. Appl. No. 17/143,286 filed Jan. 7, 2021, 24 pages.

* cited by examiner

INTEGRATED FCC AND AROMATIC RECOVERY COMPLEX TO BOOST BTX AND LIGHT OLEFIN PRODUCTION

FIELD

Embodiments of the present disclosure generally relate to refining hydrocarbon oil, and pertain particularly to a process for converting diesel to products comprising light olefins, benzene-toluene-xylenes (BTX), fluid catalytically cracked naphtha, pyrolysis gasoline, and pyrolysis fuel oil.

TECHNICAL BACKGROUND

Hydrocracking processes are used commercially in a large number of petroleum refineries to process a variety of hydrocarbon feeds boiling in the range of 370° C. to 565° C. in conventional hydrocracking units and boiling at 565° C. and above in residue hydrocracking units. In general, hydrocracking processes split the molecules of the hydrocarbon feed into smaller, i.e., lighter, molecules having higher average volatility and economic value. Additionally, hydrocracking processes typically improve the quality of the hydrocarbon feedstock by increasing the hydrogen-to-carbon ratio and by removing organosulfur and organonitrogen compounds.

Catalytic reforming is a major conversion process in petroleum refining and petrochemical industries. The reforming process catalytically converts low octane naphtha that has been, for example, distilled from crude oil into higher octane reformate used in gasoline blending and aromatic rich reformates used for aromatic production. The process rearranges or restructures the hydrocarbon molecules in naphtha feedstocks and breaks some of the molecules into smaller molecules. Naphtha feedstocks for catalytic reforming include heavy straight run naphtha. Thus, catalytic reforming transforms low octane naphtha into high-octane motor gasoline blending stock and aromatics rich in BTX with hydrogen and liquefied petroleum gas as a byproduct. Additional high value chemicals can be obtained from the reformate using an aromatic recovery complex (ARC).

Fluid catalytic cracking converts heavy feedstocks, such as vacuum distillates, atmospheric residues, and deasphalted oil, into lighter products rich in olefins and aromatics. In FCC processes, petroleum derived hydrocarbons are catalytically cracked with an acidic catalyst maintained in a fluidized state, which is regenerated on a continuous basis. The main product from such processes has generally been gasoline. However, other products are also produced in smaller quantities via FCC processes such as liquefied petroleum gas and cracked gas oil. In recent years there has been a tendency to produce, in addition to gasoline, light olefins, which are valuable raw materials for various chemical processes.

Diesel is not a normal feedstock for fluid catalytic cracking because diesel is typically thought of as high value product. However, a large surplus of diesel is projected in the long term. In contrast, a shortage is projected for high value chemicals, such as light olefins, aromatics, and chemicals made from these.

SUMMARY

Therefore, there is a continual need for improved processes for chemicals production. Described herein are processes that use the normally high-value straight run diesel fraction to produce higher value chemicals.

According to an embodiment, a process for converting diesel to products comprising light olefins, benzene-toluene-xylenes (BTX), fluid catalytically cracked naphtha, pyrolysis gasoline, and pyrolysis fuel oil includes: introducing a diesel feedstream to a diesel hydrodesulfurization unit to produce a desulfurized diesel stream; introducing the desulfurized diesel stream to a fluid catalytic cracking (FCC) unit to produce the fluid catalytically cracked naphtha, a light gas stream, and a cycle oils stream; introducing the fluid catalytically cracked naphtha to an aromatic recovery complex to produce the BTX and an aromatic bottoms stream; and introducing a paraffinic fraction of the light gas stream to a steam cracking unit to produce a light olefins stream, the pyrolysis gasoline, and the pyrolysis fuel oil.

Additional features and advantages of the embodiments described herein will be set forth in the detailed description which follows, and in part will be readily apparent to those skilled in the art from that description or recognized by practicing the embodiments described, including the detailed description and the claims which are provided infra.

BRIEF DESCRIPTION OF THE DRAWINGS

The following detailed description of specific embodiments of the present disclosure can be best understood when read in conjunction with the following drawings in which.

Figure

DETAILED DESCRIPTION

As used herein, the term "hydrocarbon oil" or "hydrocarbon feedstock" refers to an oily liquid composed mostly of a mixture of hydrocarbon compounds. Hydrocarbon oil may include refined oil obtained from crude oil, synthetic crude oil, bitumen, oil sand, shale oil, or coal oil. The term "refined oil" includes, but is not limited to, vacuum gas oil (VGO), deasphalted oil (DAO) obtained from a solvent deasphalting process, demetallized oil (DMO), light and/or heavy coker gas oil obtained from a coker process, cycle oil obtained from an FCC process, and gas oil obtained from a visbreaking process.

As used herein, the term "hydrocarbon" refers to a chemical compound composed entirely of carbon and hydrogen atoms. An expression such as "$C_x$-$C_y$ hydrocarbon" refers to a hydrocarbon having from x to y carbon atoms. For instance, a $C_1$-$C_5$ hydrocarbon includes methane, ethane, propane, the butanes, and the pentanes.

As used herein, the term "hydrogen/oil ratio" or "hydrogen-to-oil ratio" or "hydrogen-to-hydrocarbon ratio" refers to a standard measure of the volume rate of hydrogen circulating through the reactor with respect to the volume of feed. The hydrogen/oil ratio may be determined by comparing the flow volume of the hydrogen gas stream and the flow volume of the hydrocarbon feed.

As used herein, the term "liquid hourly space velocity" or "LHSV" refers to the ratio of the liquid flow rate of the hydrocarbon feed to the catalyst volume or mass.

As used herein, the term "research octane number" or "RON" refers to a property of fuels that is related to the amount of compression the fuel can withstand before detonating. RON may be calculated similar to the method found in Anderson et al., "Calculations of the Research Octane and Motor Gasolines from Gas Chromatographic Data and a New Approach to Motor Gasoline Quality Control," *Journal of the Institute of Petroleum*, vol. 52, pp. 83-93 (1972). In the method, each compound has an index, and the individual components are grouped. The octane number is calculated from the octane number of the group. The concentration of each group is multiplied with the octane number of each component and the sum gives the predicted octane number.

As used herein, the term "conduit" includes casings, liners, pipes, tubes, coiled tubing, and mechanical structures with interior voids.

As used herein, the term "decreased content" of a substance means that a concentration of the substance is greater before passing through a stage of the process under examination than it is after passing through the stage. As used herein, the term "increased content" of a substance means that a concentration of the substance is greater after passing through a stage of the process under examination than it is before passing through the stage.

Figure 1:
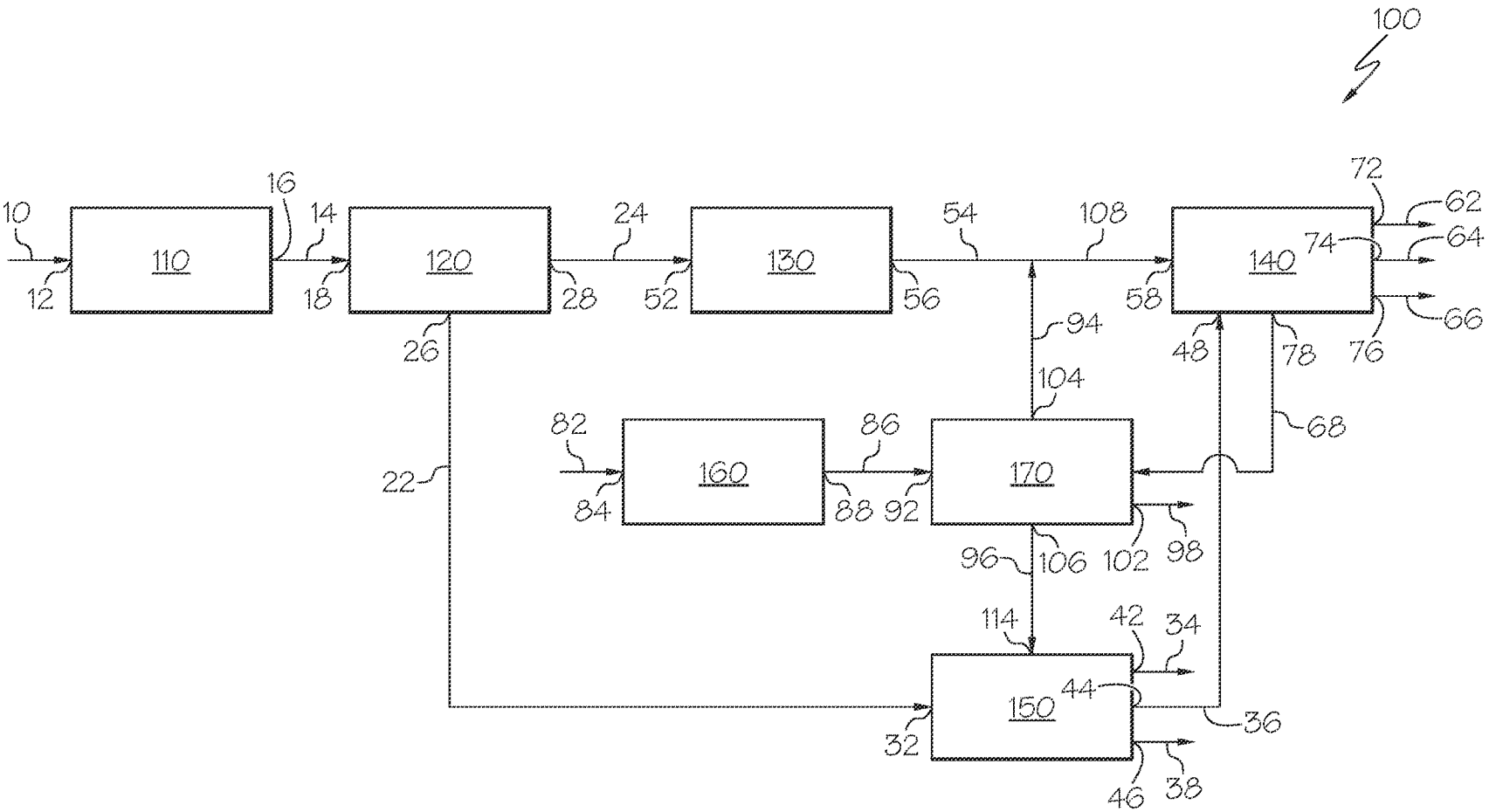
(FIG. 1 depicts a process having an integrated FCC and aromatic recovery complex in accordance with embodiments described herein.

Referring now to FIG. 1, a process flow diagram of an integrated FCC unit, catalytic reforming unit, and ARC is provided. Apparatus 100 includes a naphtha hydrodesulfurization unit 110, a naphtha splitter 120, a catalytic reforming unit 130, an ARC 140, a steam cracking unit 150, a diesel hydrodesulfurization unit 160, and an FCC unit 170.

In operation, heavy naphtha 10 is fed into inlet 12 of the naphtha hydrodesulfurization unit 110. As used herein, the term "heavy naphtha" refers to a mixture of substances primarily comprised of $C_7$ to $C_{11}$ hydrocarbons. The naphtha hydrodesulfurization unit 110 catalytically desulfurizes the heavy naphtha 10 by passing the heavy naphtha 10 over a bed of catalyst at an elevated temperature and elevated pressure. For instance, the catalyst may include a metal selected from cobalt, tungsten, nickel, molybdenum, or some combination of these, on a support, such as alumina or silica. As used in this context, an "elevated temperature" includes a temperature from 250° C. to 400° C., from 260° C. to 380° C., from 270° C. to 370° C., from 280° C. to 350° C., from 290° C. to 340° C., or even from 300° C. to 320° C. As used in this context, an "elevated pressure" includes a pressure from 1 MPa to 50 MPa, from 1 MPa to 45 MPa, from 1 MPa to 40 MPa, from 1 MPa to 35 MPa, from 1 MPa to 30 MPa, from 1 MPa to 25 MPa, from 1 MPa to 20 MPa, from 1 MPa to 15 MPa, from 1 MPa to 10 MPa, from 1 MPa to 9 MPa, from 1 MPa to 8 MPa, from 1 MPa to 7 MPa, from 1 MPa to 6 MPa, from 1 MPa to 5 MPa, from 1 MPa to 4 MPa, from 1 MPa to 3 MPa, from 5 MPa to 50 MPa, from 10 MPa to 50 MPa, from 15 MPa to 50 MPa, from 20 MPa to 50 MPa, or even from 25 MPa to 50 MPa. The LHSV within naphtha hydrodesulfurization unit 110 may be from 2 $h^{-1}$ to 10 $h^{-1}$, from 3 $h^{-1}$ to 9 $h^{-1}$, from 4 $h^{-1}$ to 8 $h^{-1}$, or even from 5 $h^{-1}$ to 7 $h^{-1}$. Desulfurized naphtha 14 exits the naphtha hydrodesulfurization unit 110 through outlet 16.

Outlet 16 of the naphtha hydrodesulfurization unit 110 is in fluid communication with an inlet 18 of naphtha splitter 120. Naphtha splitter 120 splits the desulfurized naphtha 14 into desulfurized light naphtha 22 and desulfurized heavy naphtha 24. As used herein, the term "desulfurized light naphtha" refers to light naphtha, that is, naptha composed of primarily $C_5$ to $C_6$ hydrocarbons, having a sulfur content of less than or equal to 0.5 parts per million by weight ("ppmw") and a nitrogen content of less than or equal to 0.5 ppmw. As used herein, the term "desulfurized heavy naphtha" refers to heavy naphtha, that is, naptha composed of primarily $C_7$ to $C_{11}$ hydrocarbons, having a sulfur content of less than or equal to 0.5 ppmw and a nitrogen content of less than or equal to 0.5 ppmw. In a typical naphtha splitting process, the desulfurized naphtha 14 is passed through a series of separation columns at a temperature and pressure sufficient to separate $C_6$ hydrocarbons and $C_7$ hydrocarbons. Desulfurized light naphtha 22 exits the naphtha splitter 120 through outlet 26, and desulfurized heavy naphtha 24 exits the naphtha splitter 120 through outlet 28.

Outlet 26 of the naphtha splitter 120 may be in fluid communication with inlet 32 of steam cracking unit 150. Steam cracking unit 150 breaks down the desulfurized light naphtha 22 into light olefins 34, pyrolysis gasoline 36, and pyrolysis fuel oil 38 by thermally cracking the desulfurized light naphtha 22 using steam in steam cracking furnaces. As used herein, the term "light olefins" refers to ethylene, propylene, and butylene. The steam cracking unit 150 may contain multiple zones, such as a convection zone and a pyrolysis zone, and may be operated at an elevated temperature and elevated pressure, both of which may be the same or different in the multiple zones. As used in this context, an "elevated temperature" includes a temperature from 350° C. to 950° C., from 400° C. to 950° C., from 350° C. to 450° C., from 800° C. to 950° C., from 800° C. to 900° C., or even from 850° C. to 900° C. As used in this context, an "elevated pressure" includes a pressure from 1 MPa to 10 MPa, from 1 MPa to 9 MPa, from 1 MPa to 8 MPa, from 1 MPa to 7 MPa, from 1 MPa to 6 MPa, from 1 MPa to 5 MPa, from 1 MPa to 4 MPa, from 1 MPa to 3 MPa, from 1 MPa to 2 MPa, from 2 MPa to 10 MPa, from 3 MPa to 10 MPa, from 4 MPa to 10 MPa, from 5 MPa to 10 MPa, or even from 6 MPa to 10 MPa. The desulfurized light naphtha 22 may reside in each zone of the steam cracking unit 150 for a residence time, which may be the same or different in each zone, and may be represented by LHSV, which is inversely proportional to residence time. For instance, the LHSV may be from 0.1 $h^{-1}$ to 1.5 $h^{-1}$, from 0.2 $h^{-1}$ to 1.5 $h^{-1}$, from 0.3 $h^{-1}$ to 1.5 $h^{-1}$, from 0.4 $h^{-1}$ to 1.5 $h^{-1}$, from 0.5 $h^{-1}$ to 1.5 $h^{-1}$, from 0.6 $h^{-1}$ to 1.5 $h^{-1}$, from 0.7 $h^{-1}$ to 1.5 $h^{-1}$, from 0.8 $h^{-1}$ to 1.5 $h^{-1}$, from 0.9 $h^{-1}$ to 1.5 $h^{-1}$, from 1 $h^{-1}$ to 1.5 $h^{-1}$, from 1.1 $h^{-1}$ to 1.5 $h^{-1}$, from 1.2 $h^{-1}$ to 1.5 $h^{-1}$, from 1.3 $h^{-1}$ to 1.5 $h^{-1}$, from 0.1 $h^{-1}$ to 1 $h^{-1}$, from 0.2 $h^{-1}$ to 1 $h^{-1}$, from 0.3 $h^{-1}$ to 1 $h^{-1}$, from 0.4 $h^{-1}$ to 1 $h^{-1}$, from 0.5 $h^{-1}$ to 1 $h^{-1}$, or even from 0.6 $h^{-1}$ to 1 $h^{-1}$. Steam may be placed in contact with the desulfurized light naphtha 22 at a steam-to-hydrocarbon ratio (in L of steam per L of hydrocarbon) in one zone from 0.3 to 2, from 0.3 to 1.9, from 0.3 to 1.8, from 0.3 to 1.7, from 0.3 to 1.6, from 0.3 to 1.5, from 0.3 to 1.4, from 0.3 to 1.3, from 0.3 to 1.2, from 0.3 to 1.1, from 0.3 to 1, from 0.3 to 0.9, from 0.3 to 0.8, from 1 to 2, from 1.1 to 2, from 1.2 to 2, from 1.3 to 2, from 1.4 to 2, or even from 1.5 to 2. In another zone, the steam-to-hydrocarbon ratio may be from 60 to 3000, from 60 to 2500, from 60 to 2000, from 60 to 1500, from 60 to 1000, from 60 to 900, from 60 to 800, from 60 to 700, from 60 to 600, from 60 to 500, from 60 to 400, from 60 to 300, from 60 to 200, from 500 to 3000, from 500 to 2500, from 500 to 2000, from 500 to 1500, from 500 to 1000, from 800 to 3000, from 800 to 2500, from 800 to 2000, from 800 to 1500, from 800 to 1000, from 1000 to 3000, from 1000 to 2500, from 1000 to 2000, or even from 1000 to 1500. The light olefins 34 exit the steam cracking unit 150 through outlet 42, the pyrolysis gasoline 36 exits the steam cracking unit 150 through outlet 44, and the pyrolysis fuel oil 38 exits the steam cracking unit 150 through outlet 46.

Outlet 44 of the steam cracking unit 150 may be in fluid communication with inlet 48 of ARC 140 such that the pyrolysis gasoline 36 may be fed into ARC 140. Light olefins 34, which may include primarily ethylene, propylene, and butylene, may be collected as a final product or for use in further chemical processes. Pyrolysis fuel oil 36 may be collected for use as a combustion fuel or hydrocracked further to recover BTX aromatics and non-aromatics as gasoline blending components.

Outlet 28 of the naphtha splitter 120 may be in fluid communication with inlet 52 of catalytic reforming unit 130, which accepts the desulfurized heavy naphtha 24 from the naphtha splitter 120. Catalytic reforming unit 130 uses catalytic reactions to process the primarily low octane desulfurized heavy naphtha 24 into reformate 54, which includes high octane aromatics. As used herein, the term "high octane" refers to an octane number of greater than or equal to 90. There are four major types of reactions taking place during reforming processes: (1) dehydrogenation of naphthenes to aromatics; (2) dehydrocyclization of paraffins to aromatics; (3) isomerization; and (4) hydrocracking. The dehydrogenation reactions are very endothermic, requiring the hydrocarbon stream to be heated between each catalyst bed. All but the hydrocracking reaction releases hydrogen which can be used in the hydrotreating or hydrocracking processes. Fixed or moving bed processes are utilized in a series of three to six reactors. The desulfurized heavy naphtha 24 may be passed over the catalyst bed with a LHSV from from 0.5 $h^{-1}$ to 5 $h^{-1}$, from 0.5 $h^{-1}$ to 4 $h^{-1}$, from 0.5 $h^{-1}$ to 3 $h^{-1}$, from 0.5 $h^{-1}$ to 2 $h^{-1}$, from 0.5 $h^{-1}$ to 1 $h^{-1}$, from 1 $h^{-1}$ to 5 $h^{-1}$, from 1 $h^{-1}$ to 4 $h^{-1}$, from 1 $h^{-1}$ to 3 $h^{-1}$, or even from 1 $h^{-1}$ to 2 $h^{-1}$. Reformate 54 exits the catalytic reforming unit 130 through outlet 56.

Commercial catalytic reforming processes use one or more of moving-bed processes, fluid-bed processes, and fixed-bed processes. The moving- and fluid-bed processes use mixed, non-precious metal oxide catalysts in units equipped with separate regeneration facilities. Fixed-bed processes use predominantly platinum-containing and/or palladium-containing catalysts in units equipped for cycle, occasional, or no regeneration.

The catalytic reforming unit 130 is operated at an elevated temperature. As used in this context, an "elevated temperature" includes a temperature from 450° C. to 600° C., from 460° C. to 600° C., from 470° C. to 600° C., from 480° C. to 600° C., from 490° C. to 600° C., from 500° C. to 600° C., from 510° C. to 600° C., from 520° C. to 600° C., from 530° C. to 600° C., from 540° C. to 600° C., from 550° C. to 600° C., from 560° C. to 600° C., from 570° C. to 600° C., from 580° C. to 600° C., from 590° C. to 600° C., from 450° C. to 590° C., from 450° C. to 580° C., from 450° C. to 570° C., from 450° C. to 560° C., from 450° C. to 550° C., from 450° C. to 540° C., from 450° C. to 530° C., from 450° C. to 520° C., from 450° C. to 510° C., from 450° C. to 500° C., from 450° C. to 490° C., from 450° C. to 480° C., from 450° C. to 470° C., or even from 450° C. to 460° C.

The catalytic reforming unit 130 is operated at an elevated pressure of hydrogen. As used in this context, the pressure of the hydrogen includes a pressure from 0.7 MPa to 7 MPa, 1 MPa to 7 MPa, from 1.5 MPa to 7 MPa, from 2 MPa to 7 MPa, from 2.5 MPa to 7 MPa, from 3 MPa to 7 MPa, from 3.5 MPa to 7 MPa, from 4 MPa to 7 MPa, from 4.5 MPa to 7 MPa, from 5 MPa to 7 MPa, from 5.5 MPa to 7 MPa, from 6 MPa to 7 MPa, from 0.7 MPa to 6.5 MPa, from 0.7 MPa to 6 MPa, from 0.7 MPa to 5.5 MPa, from 0.7 MPa to 5 MPa, from 0.7 MPa to 4.5 MPa, from 0.7 MPa to 4 MPa, from 0.7 MPa to 3.5 MPa, from 0.7 MPa to 3 MPa, from 0.7 MPa to 2.5 MPa, from 0.7 MPa to 2 MPa, from 0.7 MPa to 1.5 MPa, or even from 0.7 MPa to 1 MPa. In embodiments, the hydrogen is added to the catalytic reforming unit 130 at a hydrogen-to-oil molar ratio from 3 to 10, from 3 to 9, from 3 to 8, from 3 to 7, from 3 to 6, from 3 to 5, from 3 to 4, from 4 to 10, from 5 to 10, from 6 to 10, from 7 to 10, from 8 to 10, or even from 9 to 10. In embodiments, the LHSV of the desulfurized heavy naphtha 24 through the catalytic reforming unit may be from 0.5 $h^{-1}$ to 1.5 $h^{-1}$, from 0.5 $h^{-1}$ to 1.4 $h^{-1}$, from 0.5 $h^{-1}$ to 1.3 $h^{-1}$, from 0.5 $h^{-1}$ to 1.2 $h^{-1}$, from 0.5 $h^{-1}$ to 1.1 $h^{-1}$, from 0.5 $h^{-1}$ to 1 $h^{-1}$, from 0.5 $h^{-1}$ to 0.9 $h^{-1}$, from 0.5 $h^{-1}$ to 0.8 $h^{-1}$, from 0.5 $h^{-1}$ to 0.7 $h^{-1}$, from 0.5 $h^{-1}$ to 0.6 $h^{-1}$, from 0.6 $h^{-1}$ to 1.5 $h^{-1}$, from 0.7 $h^{-1}$ to 1.5 $h^{-1}$, from 0.8 $h^{-1}$ to 1.5 $h^{-1}$, from 0.9 $h^{-1}$ to 1.5 $h^{-1}$, from 1 $h^{-1}$ to 1.5 $h^{-1}$, from 1.1 $h^{-1}$ to 1.5 $h^{-1}$, from 1.2 $h^{-1}$ to 1.5 $h^{-1}$, from 1.3 $h^{-1}$ to 1.5 $h^{-1}$, or even from 1.4 $h^{-1}$ to 1.5 $h^{-1}$.

Outlet 56 of the catalytic reforming unit 130 may be in fluid communication with inlet 58 of ARC 140. In the ARC 140, reformate 54 from the catalytic reforming unit 130 may be split into a light reformate fraction and a heavy reformate fraction. The light reformate is sent to a benzene extraction unit to extract the benzene and recover almost benzene-free gasoline and a benzene stream 62. Toluene stream 64 may be extracted from the almost benzene-free gasoline. The heavy reformate stream is sent to a p-xylene extraction unit to recover p-xylene stream 66. Other xylenes may be recovered and sent to a xylene isomerization unit to convert them to p-xylene, and the converted fraction is recycled back to the p-xylene extraction unit. The heavy fraction (C9+) from the p-xylene extraction unit is recovered as process reject or aromatic bottoms stream 68. The benzene stream 62 exits the ARC 140 through outlet 72, the toluene stream 64 exits the ARC 140 through outlet 74, the p-xylene stream 66 exits the ARC 140 through outlet 76. The aromatic bottoms stream 68 exits the ARC 140 through outlet 78 and may be fed into the FCC unit 170, which is described more fully below. In embodiments, the aromatic bottoms stream 68 is not used as a feedstock for the diesel hydrodesulfurization unit 160.

Diesel stream 82 may be fed to the diesel hydrodesulfurization unit 160 through inlet 84. As used herein, the term "diesel" refers to a feedstock that boils in the range 180° C. to 370° C. or is composed primarily of $C_{12}$ to $C_{20}$ hydrocarbons. The diesel hydrodesulfurization unit 160 catalytically desulfurizes the diesel stream 82 by passing the diesel stream 82 over a bed of catalyst at an elevated temperature and elevated pressure. For instance, the catalyst may include a metal selected from cobalt, tungsten, nickel, molybdenum, or some combination of these, on a support, such as alumina or silica. As used in this context, an "elevated temperature" includes a temperature from 300° C. to 420° C., from 320° C. to 400° C., or even from 340° C. to 380° C. As used in this context, an "elevated pressure" includes a pressure from 0 MPa to 5.5 MPa, from 1 MPa to 4 MPa, from 2 MPa to 4 MPa, or even from 3 MPa to 4 MPa. Desulfurized diesel 86 exits the diesel hydrodesulfurization unit 160 through outlet 88.

The diesel hydrodesulfurization unit 160 is operated at an elevated pressure of hydrogen. As used in this context, the pressure of the hydrogen includes a hydrogen partial pressure from 0 MPa to 5.5 MPa, from 0 MPa to 5 MPa, from 0 MPa to 4.5 MPa, from 0 MPa to 4 MPa, from 0 MPa to 3.5 MPa, from 0 MPa to 3 MPa, from 0 MPa to 2.5 MPa, from 0 MPa to 2 MPa, from 0 MPa to 1.5 MPa, from 0 MPa to 1 MPa, from 0.5 MPa to 5.5 MPa, from 1 MPa to 5.5 MPa, from 1.5 MPa to 5.5 MPa, from 2 MPa to 5.5 MPa, from 2.5 MPa to 5.5 MPa, from 3 MPa to 5.5 MPa, from 3.5 MPa to 5.5 MPa, from 4 MPa to 5.5 MPa, or even from 4.5 MPa to 5.5 MPa. Hydrogen partial pressure is calculated as follows:

Hydrogen partial pressure=Reactor operating pressure×hydrogen purity %.

For example, if the hydrogen partial pressure requirement is 4 MPa and the hydrogen purity is 88 volume %, the reactor operating pressure is: 4 MPa/0.88=4.55 MPa In embodiments, the hydrogen is added to the catalytic reforming unit 130 at a hydrogen-to-oil ratio from 100 standard liters of hydrogen per liter of diesel (StLt/Lt) to 1000 StLt/Lt, from 100 StLt/Lt to 900 StLt/Lt, from 100 StLt/Lt to 800 StLt/Lt, from 100 StLt/Lt to 700 StLt/Lt, from 100 StLt/Lt to 600 StLt/Lt, from 100 StLt/Lt to 500 StLt/Lt, from 100 StLt/Lt to 400 StLt/Lt, or even from 100 StLt/Lt to 300 StLt/Lt. In embodiments, the LHSV of the diesel in the diesel hydrodesulfurization unit 160 may be from 0.5 $h^{-1}$ to 6 $h^{-1}$, from 0.5 $h^{-1}$ to 5.5 $h^{-1}$, from 0.5 $h^{-1}$ to 5 $h^{-1}$, from 0.5 $h^{-1}$ to 4.5 $h^{-1}$, or even from 0.5 $h^{-1}$ to 4 $h^{-1}$.

Outlet 88 of the diesel hydrodesulfurization unit 160 may be in fluid communication with inlet 92 of FCC unit 170. FCC unit 170 converts the desulfurized diesel 86 into fluid catalytically cracked naphtha 94, light gases 96 (which may comprise primarily $C_1$ to $C_4$ paraffins and olefins), and cycle oils 98. The light gases 96 may be separated into a paraffinic fraction (primarily $C_1$ to $C_4$ paraffins) and an olefinic fraction (primarily $C_1$ to $C_4$ olefins). The cycle oils 98 exit the FCC unit 170 through outlet 102, the fluid catalytically cracked naphtha 94 exits the FCC unit 170 through outlet 104, and the light gases 96 exit the FCC unit 170 through outlet 106. In embodiments, the FCC unit 170 may be in downflow (downer) operation or in upflow (riser reactor) operation.

In embodiments, FCC catalysts may include solid acids of fine-particles, such as zeolites (for example, synthetic Y-faujasite), aluminum silicate, treated clay (kaolin), bauxite, and silica-alumina. The zeolite content in FCC catalysts may be in the range from 5 wt. % to 40 wt. %, or even greater, with the balance being silica-alumina amorphous matrix. Catalyst additives to the FCC process may be used to enhance the octane number of the gasoline fraction and light olefin yield and to reduce $SO_x$, CO oxidation and gasoline sulfur. In embodiments, the catalyst additive may aid in producing a higher concentration of propylene relative to the concentration of propylene provided in the absence of the catalyst additive. In embodiments, the catalyst additive may include at least one synthetic zeolite having an MFI framework, a beta framework, or a mordenite framework. In embodiments, the FCC catalysts may contain from 5 wt. % to 15 wt. %, from 5 wt. % to 14 wt. %, from 5 wt. % to 13 wt. %, from 5 wt. % to 12 wt. %, from 5 wt. % to 11 wt. %, from 5 wt. % to 10 wt. %, from 5 wt. % to 9 wt. %, from 5 wt. % to 8 wt. %, from 5 wt. % to 7 wt. %, from 5 wt. % to 6 wt. %, from 6 wt. % to 15 wt. %, from 7 wt. % to 15 wt. %, from 8 wt. % to 15 wt. %, from 9 wt. % to 15 wt. %, from 10 wt. % to 15 wt. %, from 11 wt. % to 15 wt. %, from 12 wt. % to 15 wt. %, from 13 wt. % to 15 wt. %, or even from 14 wt. % to 15 wt. % catalyst additive.

The FCC unit 170 functions by passing the desulfurized diesel 86 over a bed of the catalyst at an elevated temperature and elevated pressure. As used in this context, an "elevated temperature" includes a temperature from 450° C. to 700° C., from 500° C. to 650° C., from 510° C. to 640° C., from 520° C. to 630° C., or even from 530° C. to 620° C. As used in this context, an "elevated pressure" includes a pressure from 1 MPa to 20 MPa, from 1 MPa to 19 MPa, from 1 MPa to 18 MPa, from 1 MPa to 17 MPa, from 1 MPa to 16 MPa, from 1 MPa to 15 MPa, from 1 MPa to 14 MPa, from 1 MPa to 13 MPa, from 1 MPa to 12 MPa, from 1 MPa to 11 MPa, from 1 MPa to 10 MPa, from 1 MPa to 9 MPa, from 1 MPa to 8 MPa, from 1 MPa to 7 MPa, from 1 MPa to 6 MPa, from 1 MPa to 5 MPa, from 1 MPa to 4 MPa, from 1 MPa to 3 MPa. In embodiments, the desulfurized diesel 86 is added to the FCC unit 170 at a catalyst-to-oil weight ratio from 1 to 60, from 1 to 55, from 1 to 50, from 1 to 45, from 1 to 40, from 1 to 35, from 1 to 30, from 1 to 25, from 1 to 20, from 1 to 15, from 1 to 10, from 1 to 5, from 2 to 60, from 3 to 60, from 4 to 60, from 5 to 60, from 5 to 60, from 6 to 60, from 7 to 60, from 8 to 60, from 9 to 60, from 10 to 60, from 15 to 60, from 20 to 60, from 25 to 60, from 30 to 60, from 35 to 60, from 40 to 60, or even from 45 to 60, and at an LHSV of the hydrogen from 0.5 $h^{-1}$ to 6 $h^{-1}$, from 0.5 $h^{-1}$ to 5.5 $h^{-1}$, from 0.5 $h^{-1}$ to 5 $h^{-1}$, from 0.5 $h^{-1}$ to 4.5 $h^{-1}$, or even from 0.5 $h^{-1}$ to 4 $h^{-1}$. In embodiments, the desulfurized diesel 86 may reside in the FCC unit 170 for a residence time from 0.1 s to 30 s, from 0.1 s to 25 s, from 0.1 s to 20 s, from 0.1 s to 15 s, from 0.1 s to 10 s, from 0.1 s to 9 s, from 0.1 s to 8 s, from 0.1 s to 7 s, from 0.1 s to 6 s, from 0.1 s to 5 s, from 0.1 s to 4 s, or even from 0.1 s to 3 s.

In embodiments, the fluid catalytically cracked naphtha 94 may be combined with the reformate 54, with the combined stream 108 fed to the ARC 140. Alternatively, the fluid catalytically cracked naphtha 94 may be directly fed into the ARC 140.

Outlet 106 of the FCC unit 170 may be in fluid communication with inlet 114 of steam cracking unit 150, such that the paraffinic light gases (comprising primarily $C_2$ to $C_4$ paraffins) may act as a further feedstock for steam cracking unit 150.

According to an aspect, either alone or in combination with any other aspect, a process for converting diesel to products comprising light olefins, benzene-toluene-xylenes (BTX), fluid catalytically cracked naphtha, pyrolysis gasoline, and pyrolysis fuel oil includes: introducing a diesel feedstream to a diesel hydrodesulfurization unit to produce a desulfurized diesel stream; introducing the desulfurized diesel stream to a fluid catalytic cracking (FCC) unit to produce the fluid catalytically cracked naphtha, a light gas stream, and a cycle oils stream; introducing the fluid catalytically cracked naphtha to an aromatic recovery complex to produce the BTX and an aromatic bottoms stream; and introducing a paraffinic fraction of the light gas stream to a steam cracking unit to produce a light olefins stream, the pyrolysis gasoline, and the pyrolysis fuel oil.

According to a second aspect, either alone or in combination with any other aspect, the process further includes: introducing a heavy naphtha stream to a naphtha hydrodesulfurization unit to produce a desulfurized naphtha stream; introducing the desulfurized naphtha stream to a naphtha splitter unit to produce a desulfurized heavy naphtha stream and a desulfurized light naphtha stream; and introducing the desulfurized light naphtha stream to the steam cracking unit.

According to a third aspect, either alone or in combination with any other aspect, the process further includes: introducing the desulfurized heavy naphtha stream to a catalytic reforming unit to produce a reformate stream; combining the reformate stream with the fluid catalytically cracked naphtha stream to produce a combined stream; and introducing the combined stream to the aromatic recovery complex.

According to a fourth aspect, either alone or in combination with any other aspect, the catalytic reforming unit is operated at a temperature from 450° C. to 600° C. and a pressure from 0.7 MPa to 7 MPa.

According to a fifth aspect, either alone or in combination with any other aspect, the catalytic reforming unit comprises a hydrogen stream having a hydrogen-to-oil ratio, on a molar basis, from 3 to 10 and a liquid hourly space velocity of the desulfurized heavy naphtha stream from 0.5 $h^{-1}$ to 1.5 $h^{-1}$.

According to a sixth aspect, either alone or in combination with any other aspect, the process further includes: introducing the pyrolysis gasoline to the aromatic recovery complex.

According to a seventh aspect, either alone or in combination with any other aspect, the process further includes: introducing the aromatic bottoms stream to the FCC unit.

According to an eighth aspect, either alone or in combination with any other aspect, the light gas stream comprises ethylene, propylene, and butenes.

According to a ninth aspect, either alone or in combination with any other aspect, the aromatic bottoms stream is not introduced to the diesel hydrodesulfurization unit.

According to a tenth aspect, either alone or in combination with any other aspect, the FCC unit is operated at a temperature from 450° C. to 700° C.

According to an eleventh aspect, either alone or in combination with any other aspect, the FCC unit is operated at a residence time from 0.1 seconds to 30 seconds.

According to a twelfth aspect, either alone or in combination with any other aspect, the FCC unit is in downflow (downer) operation or in upflow (riser reactor) operation.

According to a thirteenth aspect, either alone or in combination with any other aspect, the FCC unit comprises a zeolite containing catalyst.

According to a fourteenth aspect, either alone or in combination with any other aspect, the zeolite containing catalyst further comprises a catalyst additive to provide a higher concentration of propylene relative to the concentration of propylene provided in the absence of the catalyst additive.

According to a fifteenth aspect, either alone or in combination with any other aspect, the zeolite containing catalyst comprises from 5 wt. % to 15 wt. % the catalyst additive.

According to a sixteenth aspect, either alone or in combination with any other aspect, the zeolite containing catalyst comprises a synthetic Y-faujasite zeolite.

According to a sixteenth aspect, either alone or in combination with any other aspect, the catalyst additive comprises at least one synthetic zeolite having an MFI framework, a beta framework, or a mordenite framework.

EXAMPLES

Using embodiments described above, an exemplary refining scheme was conducted, as follows. The following examples are merely illustrative and should not be interpreted as limiting the scope of the present disclosure.

Example 1: Naphtha Hydrodesulfurization

A straight run naphtha from Arabian heavy crude oil having a specific gravity of 0.76418 and containing 184 ppmw of sulfur was desulfurized over a conventional hydrodesulfurization catalyst composed of Co—Mo as active phase metals on alumina support at a temperature of 300° C., hydrogen partial pressure of 2 MPa (20 bar), hydrogen-to-hydrocarbon ratio of 100 StLt/Lt, and LHSV of 9.5 $h^{-1}$. The resulting desulfurized naphtha included less than 0.5 ppmw sulfur, with almost full recovery of liquid volume.

Example 2: Diesel Hydrodesulfurization

A straight run diesel from Arabian heavy crude oil was desulfurized over a conventional hydrodesulfurization catalyst composed of Co—Ni—Mo as active phase metals on alumina support at a temperature of 355° C., hydrogen partial pressure of 3.3 MPa (33 bar), hydrogen-to-hydrocarbon ratio of 300 StLt/Lt, and LHSV of 1.5 $h^{-1}$. Table 1 summarizes the yield and composition of the desulfurized diesel. As seen, the resulting desulfurized diesel included less than 9 ppmw sulfur.

TABLE 1

Yield and Composition of Desulfurized Diesel

| Products obtained | Yield (wt. %) |
|---|---|
| $H_2S$ | 1.24 |
| $NH_3$ | 0.00 |
| $C_1$ | 0.03 |
| $C_2$ | 0.03 |
| $C_3$ | 0.10 |
| $C_4$ | 0.13 |
| Naphtha (177° C. and less) | 7.71 |
| Diesel (177° C.-370° C.) | 88.18 |
| Residue (370° C. and above) | 2.86 |
| Total | 100.28 |

Example 3: Catalytic Reforming

The desulfurized heavy naphtha stream from example 1 was processed over a conventional catalytic reforming catalyst of platinum on alumina at 540° C., 0.8 MPa (8 bar), hydrogen-to-hydrocarbon molar ratio of 7, and LHSV of 1 $h^{-1}$. Table 2 summarizes the yield and composition of the reformate produced. As seen, the research octane number of the reformate was 109. The reformate contained 93 wt. % aromatics, of which 4.3 wt. % was benzene, 24.5 wt. % was toluene, and 30 wt. % was xylenes.

TABLE 2

Yield, Composition, and Properties of Catalytic Reforming Process Products

| Products obtained | Yield (wt. %) |
|---|---|
| n-Paraffins | 1.99 |
| iso-Paraffins | 4.67 |
| Olefins | 0.00 |
| Naphthenes | 0.36 |
| Aromatics | 92.99 |
| Total | 100.01 |
| $C_1 + C_2$ Yield | 2.80 |
| $C_3 + C_4$ Yield | 5.70 |
| $C_5$ Yield | 85.70 |
| Hydrogen Yield | 5.10 |
| Total | 99.30 |
| **Properties** | **Value** |
| Density (g/cm$^3$) | 0.8519 |
| Research Octane Number (calculated) | 109 |

Example 4: Diesel Fluid Catalytic Cracking

An FCC micro-activity test was conducted using the hydrodesulfurized diesel oil of Example 2 as a feedstock.

The composition of the feedstock, which had a density at 15.6° C. of 0.83 g/cm$^3$, is shown in Table 3. In Table 3, the simulated distillation data provides the temperature by which the indicated wt. % of the feedstock boils off. The experiments were conducted at the conditions shown in Table 4. The catalyst was a zeolite-containing catalyst designed for maximum propylene production, which contained about 30 wt. % titanium and zirconium modified ultrastable Y-type zeolite with the remainder being alumina. ZSM-5 based catalyst additive was added to the catalyst at 5 wt. % to 15 wt. % to enhance propylene production. The catalyst was steamed at 810° C. for 6 hours prior to use. Feedstock and product distillation data are shown in Table 4. As seen, the diesel is fully converted to gasoline range products. Further, the diesel was fluid catalytically cracked to produce 23.5 wt. % of propylene and 25.9 wt. % of aromatic rich naphtha, of which 45 wt. % was mono-aromatics.

TABLE 3

Feedstock Composition for Fluid Catalytic Cracking Process

| Simulated Distillation | Boiling Temperature (° C.) |
|---|---|
| 0 wt. % | 110 |
| 5 wt. % | 177 |
| 10 wt. % | 203 |
| 30 wt. % | 255 |
| 50 wt. % | 287 |
| 70 wt. % | 318 |
| 90 wt. % | 362 |
| 95 wt. % | 379 |
| 100 wt. % | 414 |
| **Composition by 2D-GC** | **Concentration (wt. %)** |
| Paraffins | 52.68 |
| Naphthenes | 25.26 |
| Mono-aromatics | 19.49 |
| Di-aromatics | 2.57 |
| Total | 100.00 |
| **Trace Materials Present** | **Concentration (ppmw)** |
| Sulfur | <10 |
| Nitrogen | 21 |

TABLE 4

Fluid Catalytic Cracking Micro-Activity Test

| | Experiment | | | |
|---|---|---|---|---|
| | 1 | 2 | 3 | 4 |
| Reactor Temperature (° C.) | 600 | 650 | 650 | 650 |
| ZSM-5 (wt. %) | 5 | 5 | 10 | 15 |
| Catalyst-to-Oil Ratio | 5.4 | 5.4 | 5.5 | 5.3 |
| Conversion (wt. %) | 84.6 | 85.6 | 86.7 | 89.5 |
| Product Analysis | | | | |
| $H_2$ (wt. %) | 0.1 | 0.3 | 0.2 | 0.2 |
| $C_1$ (wt. %) | 1.1 | 3.2 | 2.2 | 2.5 |
| $C_2$ paraffin (wt. %) | 1.0 | 1.9 | 1.9 | 2.2 |
| $C_2$ olefin (wt. %) | 5.2 | 12.7 | 8.3 | 10.2 |
| $C_3$ paraffin (wt. %) | 2.9 | 2.5 | 3.8 | 4.0 |
| $C_3$ olefin (wt. %) | 18.3 | 21.6 | 21.8 | 23.5 |
| iso-$C_4$ paraffin (wt. %) | 7.0 | 3.5 | 5.9 | 5.1 |
| n-$C_4$ paraffin (wt. %) | 1.6 | 1.1 | 1.8 | 1.7 |
| 2-$C_4$ olefin (wt. %) | 2.9 | 2.9 | 2.4 | 2.8 |
| 1-$C_4$ olefin (wt. %) | 2.5 | 2.8 | 2.4 | 2.7 |
| iso-$C_4$ olefin (wt. % | 4.4 | 4.6 | 4.5 | 4.5 |

TABLE 4-continued

Fluid Catalytic Cracking Micro-Activity Test

| | Experiment | | | |
|---|---|---|---|---|
| | 1 | 2 | 3 | 4 |
| $C_2$-$C_4$ olefin (wt. %) | 2.4 | 2.5 | 2.3 | 2.4 |
| 1,3-butadiene (wt. %) | 0.1 | 0.1 | 0.1 | 0.7 |
| Liquid $C_4$ olefin (wt. %) | 0.2 | 0.0 | 0.1 | 0.0 |
| Total Gas (wt. %) | 49.7 | 59.7 | 57.7 | 62.5 |
| Naphtha (wt. %) | 34.2 | 24.7 | 27.8 | 25.9 |
| Light Cycle Oil (wt. %) | 12.9 | 11.3 | 11.2 | 8.8 |
| Heavy Cycle Oil (wt. %) | 2.4 | 3.1 | 2.1 | 1.6 |
| Coke (wt. %) | 0.8 | 1.2 | 1.2 | 1.2 |
| Total Components (wt. %) | 100.0 | 100.0 | 100.0 | 100.0 |

Example 5: Steam Cracking 413 kg of a mixture of paraffinic light gases ($C_2$-$C_4$) produced in the diesel fluid catalytic cracking step (see Example 4) and light naphtha from the naphtha splitter was steamed at a coil outlet temperature (COT) of 800° C. and at a coil outlet pressure (COP) of 0.15 MPa (1.5 bar). The mass flow rate of hydrocarbons (HC) was fixed in order to achieve an average residence time of 0.7 s to 1 s. The steam dilution factor was set to 0.6 kg $H_2O$ per kg of hydrocarbons. The steam cracking yields at 800° C. and a pressure of 0.15 MPa for an ethane feedstock, a propane feedstock, a butane feedstock, and a naphtha feedstock are tabulated in Table 5.

TABLE 5

Steam Cracking Yields

| | Feedstock (kg product) | | | |
|---|---|---|---|---|
| Product | Ethane | Propane | Butane | Naphtha |
| Hydrogen | 0.3 | 2.1 | 5.1 | 2.9 |
| Methane | 0.2 | 25.1 | 69.9 | 32.7 |
| Ethylene | 2.9 | 38.3 | 127.1 | 63.8 |
| Propylene | 0.1 | 15.3 | 55.0 | 29.6 |
| Butadiene | 0.1 | 2.7 | 11.1 | 8.6 |
| Other | 0.0 | 1.2 | 21.6 | 8.0 |
| Fuel | 0.0 | 0.5 | 5.4 | 8.9 |
| $C_5$ - 200° C. Products | | | | |
| Benzene | 0.0 | 2.3 | 9.5 | 12.7 |
| Toluene | 0.0 | 0.5 | 2.5 | 6.5 |
| $C_8$ aromatics | 0.0 | 0.0 | 1.3 | 3.4 |
| Non-aromatics | 0.0 | 3.3 | 9.2 | 12.9 |
| $C_5$ - 200 Total | 0.1 | 6.0 | 22.6 | 35.5 |
| Total | 3.7 | 91.3 | 317.7 | 190 |

Example 6: Overall Material Balance of a Comparative Process

Figure 2:
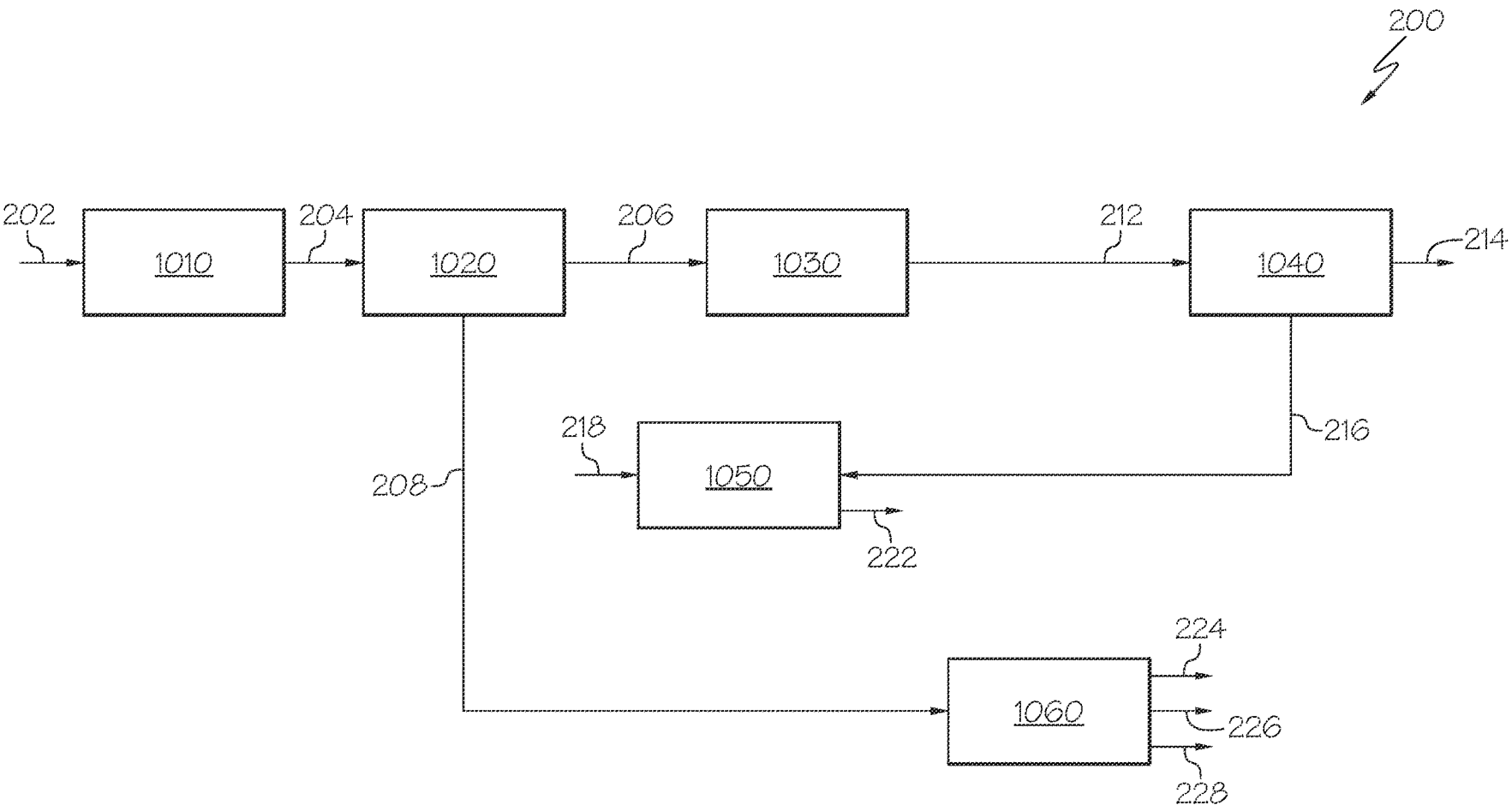
FIG. 2 depicts a conventional processing scheme in accordance with Example 6.

To evaluate the effectiveness of the process described herein, a comparative process was conducted in accordance with the system 200 of FIG. 2. In the process, heavy naphtha 202 is fed into a naphtha hydrodesulfurization unit 1010 to produce desulfurized naphtha 204. The desulfurized naphtha 204 is fed into a naphtha splitter 1020, producing desulfurized heavy naphtha 206 and desulfurized light naphtha 208. The desulfurized heavy naphtha 206 is fed into catalytic reforming unit 1030, which produces reformate 212. Reformate 212 is fed into an ARC 1040. ARC produces BTX 214 and aromatic bottoms stream 216. The BTX 214 may be collected, and the aromatic bottoms stream 216 may be fed into a diesel hydrodesulfurization unit 1050, in which diesel feed 218 and aromatic bottoms stream 216 are combined and desulfurized diesel 222 is produced. Desulfurized light naphtha 208 may be fed to steam cracking unit 1060, from which light olefins 224, pyrolysis gasoline 226, and pyrolysis fuel oil 228 are produced. The overall material balance of this process is provided in Table 6.

TABLE 6

Overall Material Balance of Comparative Process

| Stream Number | Stream Name | Weight (kg) |
|---|---|---|
| 202 | Heavy naphtha | 1200 |
| 218 | Diesel | 1000 |
| 204 | Desulfurized naphtha | 1190 |
| 206 | Desulfurized heavy naphtha | 1000 |
| 208 | Desulfurized light naphtha | 190 |
| 212 | Reformate | 1020 |
| 214 | BTX | 786 |
| 216 | Aromatic bottoms stream | 153 |
| 222 | Desulfurized diesel | 987 |
| 224 | Light olefins | 102 |
| 226 | Pyrolysis gasoline | 36 |
| 228 | Pyrolysis fuel oil | 9 |

Example 7: Overall Material Balance of an Inventive Process

A process in accordance with FIG. 1 was performed, and the overall material balance of this process is provided in Table 7.

TABLE 7

Overall Material Balance of Inventive Process

| Stream Number | Stream Name | Weight (kg) |
|---|---|---|
| 10 | Heavy naphtha | 1200 |
| 82 | Diesel | 1000 |
| 14 | Desulfurized naphtha | 1190 |
| 22 | Desulfurized heavy naphtha | 1000 |
| 24 | Desulfurized light naphtha | 190 |
| 54 | Reformate | 1020 |
| 108 | Combined stream | 970 |
| 62 + 64 + 66 | BTX | 901 |
| 68 | Aromatic bottoms stream | 182 |
| 86 | Desulfurized diesel | 987 |
| 94 | FCC naphtha | 247 |
| 86 (in part)[1] | Diesel fuel | 104 |
| 96 | Liquefied petroleum gas | 128 |
| 34 + 98 | Light olefins | 461 |
| 36 | Pyrolysis gasoline | 64 |
| 38 | Pyrolysis fuel oil | 15 |

[1]The fuel stream is a portion of the desulfurized diesel stream.

Table 6 shows fuel production without FCC and Table 7 shows fuel production with FCC. As reported, about 90% of the diesel is converted to other products, such as gasoline and light olefins, in accordance with the subject matter disclosed herein. The diesel produced in Example 7 is 104 kg, while the diesel produced in Example 6 is 987 kg. Similarly, the amount of BTX obtained in Example 7 is 115 kg more than in Example 6, and the amount of light olefins obtained in Example 7 is 359 kg more than in Example 6.

It is noted that recitations in the present disclosure of a component of the present disclosure being "operable" or "sufficient" in a particular way, to embody a particular property, or to function in a particular manner, are structural recitations, as opposed to recitations of intended use. More specifically, the references in the present disclosure to the manner in which a component is "operable" or "sufficient" denotes an existing physical condition of the component and, as such, is to be taken as a definite recitation of the structural characteristics of the component.

Having described the subject matter of the present disclosure in detail and by reference to specific embodiments, it is noted that the various details disclosed in the present disclosure should not be taken to imply that these details relate to elements that are essential components of the various embodiments described in the present disclosure. Further, it will be apparent that modifications and variations are possible without departing from the scope of the present disclosure, including, but not limited to, embodiments defined in the appended claims.

The singular forms "a", "an" and "the" include plural referents, unless the context clearly dictates otherwise.

Throughout this disclosure ranges are provided. It is envisioned that each discrete value encompassed by the ranges are also included. Additionally, the ranges which may be formed by each discrete value encompassed by the explicitly disclosed ranges are equally envisioned.

As used in this disclosure and in the appended claims, the words "comprise," "has," and "include" and all grammatical variations thereof are each intended to have an open, non-limiting meaning that does not exclude additional elements or steps.

As used in this disclosure, terms such as "first" and "second" are arbitrarily assigned and are merely intended to differentiate between two or more instances or components. It is to be understood that the words "first" and "second" serve no other purpose and are not part of the name or description of the component, nor do they necessarily define a relative location, position, or order of the component. Furthermore, it is to be understood that the mere use of the term "first" and "second" does not require that there be any "third" component, although that possibility is contemplated under the scope of the present disclosure.

What is claimed is:

1. A process for converting diesel to products comprising light olefins, benzene-toluene-xylenes (BTX), fluid catalytically cracked naphtha, pyrolysis gasoline, and pyrolysis fuel oil, said process comprising:

introducing a diesel feedstream to a diesel hydrodesulfurization unit to produce a desulfurized diesel stream;

introducing the desulfurized diesel stream to a fluid catalytic cracking (FCC) unit to produce the fluid catalytically cracked naphtha, a light gas stream, and a cycle oils stream;

introducing a heavy naphtha stream to a naphtha hydrodesulfurization unit to produce a desulfurized naphtha stream;

introducing the desulfurized naphtha stream to a naphtha splitter unit to produce a desulfurized heavy naphtha stream comprising $C_7$-$C_{11}$ hydrocarbons and a desulfurized light naphtha stream comprising $C_5$-$C_6$ hydrocarbons;

passing the desulfurized heavy naphtha stream directly from the naphtha splitter unit to a catalytic reforming unit to produce a reformate stream;

combining the reformate stream with the fluid catalytically cracked naphtha stream to produce a combined stream;

introducing the combined stream to an aromatic recovery complex to produce the BTX and an aromatic bottoms stream; and introducing the desulfurized light naphtha stream and a paraffinic fraction of the light gas stream to a steam cracking unit to produce a light olefins stream, the pyrolysis gasoline, and the pyrolysis fuel oil, wherein:

the FCC unit is operated at a residence time from 0.1 seconds to 30 seconds, and the FCC unit comprises a zeolite containing catalyst comprising from 5 wt. % to 15 wt. % of a catalyst additive to provide a higher concentration of propylene relative to the concentration of propylene provided in the absence of the catalyst additive.

2. The process of claim 1, wherein the catalytic reforming unit is operated at a temperature from 450° C. to 600° C. and a pressure from 0.7 MPa to 7 MPa.

3. The process of claim 2, wherein the catalytic reforming unit comprises a hydrogen stream having a hydrogen-to-oil ratio, on a molar basis, from 3 to 10 and a liquid hourly space velocity of the desulfurized heavy naphtha stream from 0.5 $h^{-1}$ to 1.5 $h^{-1}$.

4. The process of claim 1, further comprising introducing the pyrolysis gasoline to the aromatic recovery complex.

5. The process of claim 1, further comprising introducing the aromatic bottoms stream to the FCC unit.

6. The process of claim 1, wherein the light gas stream comprises ethylene, propylene, and butenes.

7. The process of claim 1, wherein the aromatic bottoms stream is not introduced to the diesel hydrodesulfurization unit.

8. The process of claim 1, wherein the FCC unit is operated at a temperature from 450° C. to 700° C.

9. The process of claim 1, wherein the FCC unit is in downflow (downer) operation or in upflow (riser reactor) operation.

10. The process of claim 1, wherein the zeolite containing catalyst comprises a synthetic Y-faujasite zeolite.

11. The process of claim 1, wherein the catalyst additive comprises at least one synthetic zeolite having an MFI framework, a beta framework, or a mordenite framework.

* * * * *